US012123595B2

(12) United States Patent
Nath et al.

(10) Patent No.: US 12,123,595 B2
(45) Date of Patent: Oct. 22, 2024

(54) COMBUSTOR LINER HAVING SHAPED DILUTION OPENINGS

(71) Applicant: General Electric Company, Schenectady, NY (US)

(72) Inventors: Hiranya Nath, Bengaluru (IN); Karthikeyan Sampath, Bengaluru (IN); Perumallu Vukanti, Bengaluru (IN); Ravindra Shankar Ganiger, Bengaluru (IN); Pradeep Naik, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 19 days.

(21) Appl. No.: 17/820,373

(22) Filed: Aug. 17, 2022

(65) Prior Publication Data

US 2023/0341125 A1 Oct. 26, 2023

(30) Foreign Application Priority Data

Apr. 26, 2022 (IN) ..... 202211024469

(51) Int. Cl.
*F23R 3/06* (2006.01)

(52) U.S. Cl.
CPC ..... *F23R 3/06* (2013.01)

(58) Field of Classification Search
CPC ..... F23R 3/06; F23R 3/10; F23R 2900/03041
See application file for complete search history.

(56) References Cited

U.S. PATENT DOCUMENTS

| | | | | |
|---|---|---|---|---|
| 10,222,066 | B2 | 3/2019 | Chen et al. | |
| 10,591,162 | B2 | 3/2020 | Clemen | |
| 10,890,327 | B2 | 1/2021 | Gandikota et al. | |
| 11,112,114 | B2 | 9/2021 | Pritchard et al. | |
| 2003/0046934 | A1* | 3/2003 | Sherwood | F23R 3/04 60/722 |
| 2015/0323182 | A1* | 11/2015 | Sandoval | F23R 3/06 60/752 |
| 2016/0201908 | A1* | 7/2016 | Drake | F02C 7/18 415/115 |
| 2016/0290643 | A1* | 10/2016 | Cunha | F02C 7/12 |
| 2016/0327272 | A1* | 11/2016 | Sandoval | F23R 3/50 |
| 2017/0108220 | A1* | 4/2017 | Kostka, Jr. | F23R 3/06 |
| 2019/0277501 | A1 | 9/2019 | Xu | |
| 2021/0239320 | A1 | 8/2021 | Alahyari et al. | |
| 2021/0388988 | A1 | 12/2021 | Khoun et al. | |
| 2022/0412560 | A1* | 12/2022 | Chiranthan | F23R 3/06 |

FOREIGN PATENT DOCUMENTS

| | | | | |
|---|---|---|---|---|
| EP | 3006831 | B1 | 11/2018 | |
| GB | 2512642 | A | 10/2014 | |
| WO | WO8806257 | A1 * | 8/1988 | F23R 3/04 |

* cited by examiner

*Primary Examiner* — William H Rodriguez
(74) *Attorney, Agent, or Firm* — Venable LLP; Edward A. Kmett; Michele V. Frank

(57) ABSTRACT

A combustor liner for a gas turbine includes a liner at least partially defining a combustion chamber. The liner includes a plurality of dilution openings therethrough, at least one dilution opening of the plurality of dilution openings defined by (a) a main dilution opening portion defining a main dilution opening perimeter, and (b) a plurality of secondary dilution opening portions arranged about the main dilution opening perimeter and extending outward from the main dilution opening portion.

20 Claims, 10 Drawing Sheets

COMBUSTOR LINER HAVING SHAPED DILUTION OPENINGS

CROSS REFERENCE TO RELATED APPLICATIONS

The present application claims the benefit of Indian Patent Application No. 202211024469, filed on Apr. 26, 2022, which is hereby incorporated by reference herein in its entirety.

TECHNICAL FIELD

The present disclosure relates to a combustor liner having dilution openings therethrough.

BACKGROUND

In conventional gas turbine engines, it has been known to provide a flow of dilution air into a combustion chamber downstream of a primary combustion zone. Conventionally, a combustor includes a liner that defines a combustion chamber. The liner may include dilution holes that provide a flow of air (i.e., a dilution jet) from a passage surrounding the liner into the combustion chamber.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Figure 1:
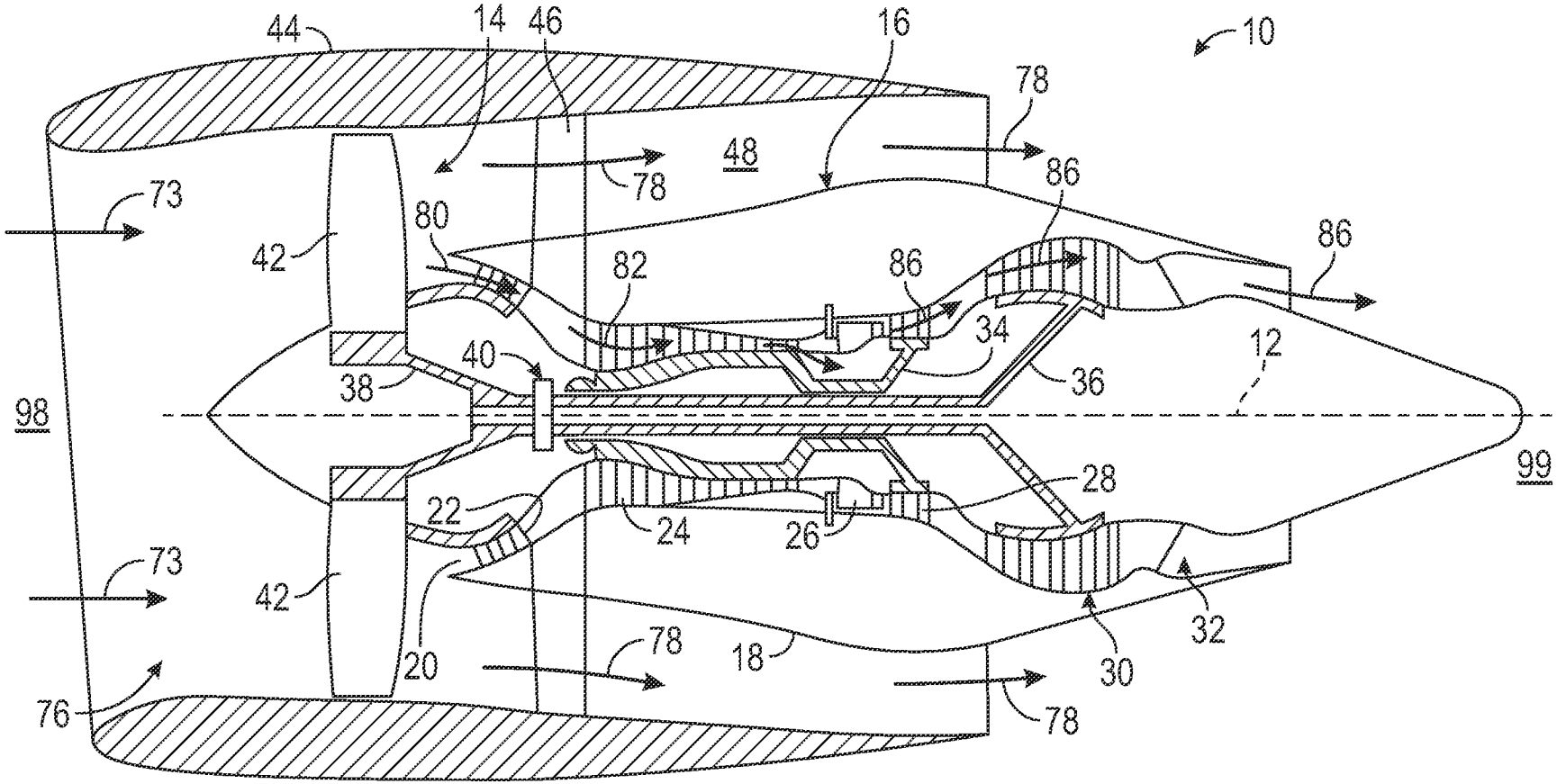
FIG. 1 is a schematic partial cross-sectional side view of an exemplary high by-pass turbofan jet engine, according to an aspect of the present disclosure.

Features, advantages, and embodiments of the present disclosure are set forth or apparent from a consideration of the following detailed description, drawings, and claims. Moreover, it is to be understood that the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and the scope of the present disclosure.

As used herein, the terms "first" and "second" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

In a combustion section of a turbine engine, airflow in an outer passage surrounding a combustor liner is diverted through dilution openings in the combustor liner and into a combustion chamber to be used as dilution air. One purpose of the dilution air is to quench (i.e., cool) combustion gases within the combustion chamber before the gases enter a turbine section downstream of the combustion chamber. At the trailing edge of the dilution opening along the inner surface of the liner (i.e., inside the combustion chamber), a wake forms in the dilution airflow behind the dilution hole. The wake results in a higher temperature behind the dilution airflow, which causes higher $NO_x$ formation, and which reduces the life of the combustor liner.

Some applications have been known to use circular holes for providing the dilution airflow to the combustion chamber. The flow of air through the circular dilution holes in the conventional combustor mixes with combustion gases within the combustion chamber to provide quenching of the combustion gases. High temperature regions may be seen behind the dilution jet (i.e., in the wake region of the dilution jet) and are associated with high nitrous oxide ($NO_x$) formation. In addition, the circular dilution hole does not spread the flow of dilution air laterally, thereby, creating high temperatures in-between dilution holes that also contribute to higher $NO_x$ formation The present disclosure provides a way to fill-in the wake region with dilution air and to provide for a better lateral spread of the dilution air within the combustion chamber, thereby reducing the $NO_x$ emissions and improving the durability of the liner. According to the present disclosure, a dilution opening includes a main dilution opening portion and at least one secondary dilution opening portion extending outward from the main dilution opening portion. In one aspect, the secondary dilution opening portion may be slotted openings that extend both laterally and longitudinally from the main dilution opening portion. In other aspects, the secondary dilution opening portions may be slit openings, and may include a tertiary dilution opening portion. In yet other aspects, the secondary dilution opening portions may be a lobe structure. Each of the aspects of the secondary dilution opening portions provides for an airflow at the trailing edge and/or a lateral airflow that reduces the wake at the trailing edge that may otherwise occur, and also provides for a better lateral spread of the dilution air into the combustion chamber.

Referring now to the drawings, FIG. 1 is a schematic partial cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine-based turbine engines, industrial turbine engines, and auxiliary power units. As shown in FIG. 1, engine 10 has an axial centerline axis 12 that extends therethrough from an upstream end 98 to a downstream end 99 for reference purposes. In general, the engine 10 may include a fan assembly 14 and a core engine 16 disposed downstream from the fan assembly 14.

The core engine 16 may generally include an outer casing 18 that defines an annular inlet 20. The outer casing 18 encases, or at least partially forms, in serial flow relationship, a compressor section (22/24) having a low pressure (LP) compressor 22 and a high pressure (HP) compressor 24, a combustor 26, a turbine section (28/30) including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive or a geared-drive configuration.

As shown in FIG. 1, the fan assembly 14 includes a plurality of fan blades 42 that are coupled to, and that extend radially outwardly from, the fan shaft 38. An annular fan casing or a nacelle 44 circumferentially surrounds the fan assembly 14 and/or at least a portion of the core engine 16. The nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
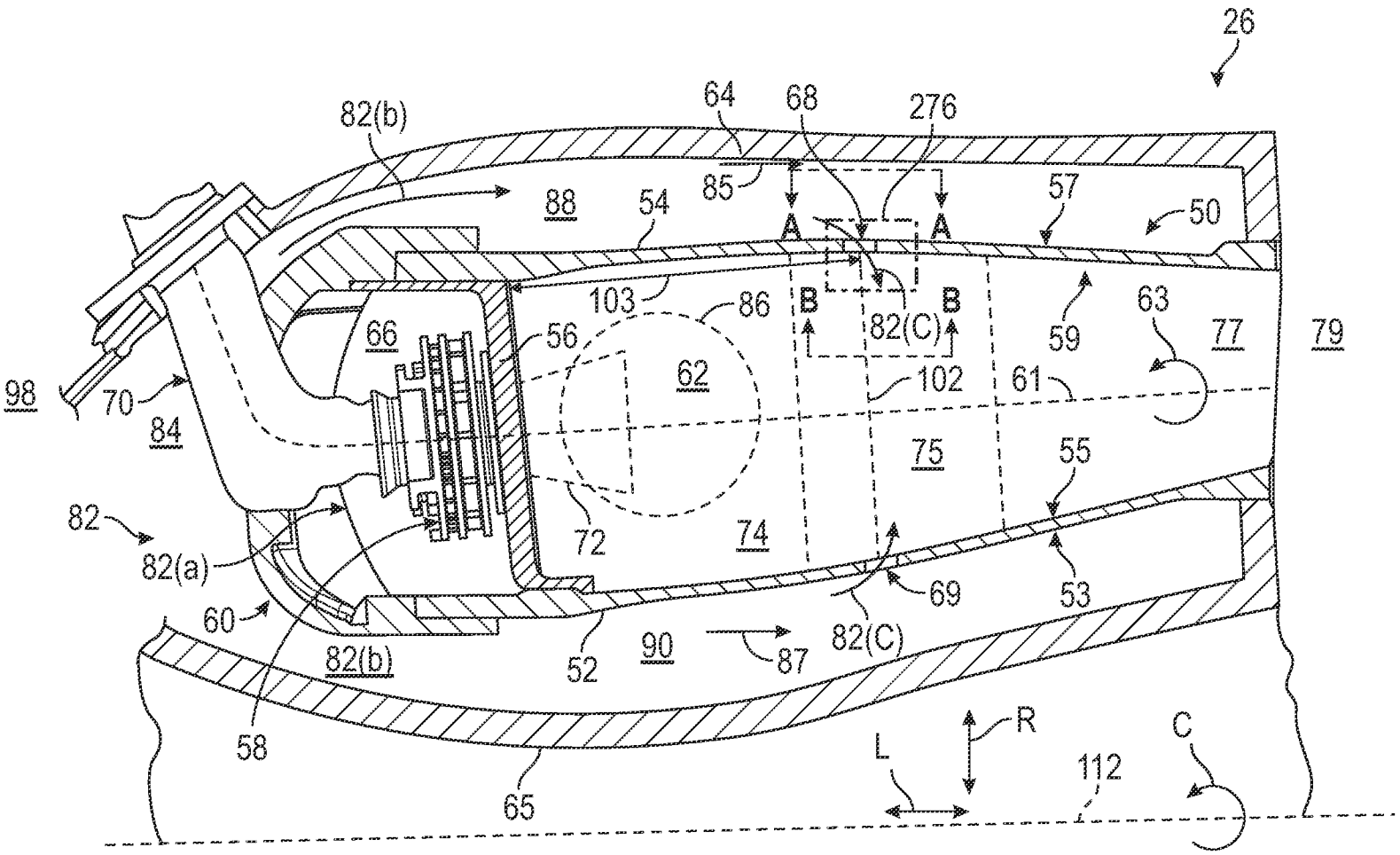
FIG. 2 is a partial cross-sectional side view of an exemplary combustor, according to an aspect of the present disclosure.

FIG. 2 is a cross-sectional side view of an exemplary combustor 26 of the core engine 16 as shown in FIG. 1. The exemplary combustor 26 shown in FIG. 2 is depicted as an annular type combustor that includes both an inner liner 52 and an outer liner 54 that each extends circumferentially about a combustor centerline axis 112, but the present disclosure can be implemented in other types of combustors, including, as one example, can-type combustors. For reference purposes, with respect to the centerline axis 112 of the combustor 26, a circumferential direction (C) may be defined extending about the combustor centerline axis 112, a longitudinal direction (L) may be defined extending along the combustor centerline axis 112, and a radial direction (R) may be defined extending outward from the combustor centerline axis 112. As shown in FIG. 2, the combustor 26 may generally include a combustor liner 50 having the inner liner 52 and the outer liner 54, and a dome assembly 56, together defining a combustion chamber 62. Both the inner liner 52 and the outer liner 54 may extend circumferentially about the combustor centerline axis 112, which may correspond to the engine axial centerline axis 12. While FIG. 2 depicts a single layer liner for both the inner liner 52 and the outer liner 54, other types of liners, such as multi-layer liners, may be included instead. The inner liner 52 and the outer liner 54 are connected to a cowl 60, and a pressure plenum 66 is defined between the cowl 60, the inner liner 52, the outer liner 54, and the dome assembly 56.

As shown in FIG. 2, the inner liner 52 is encased within an inner casing 65 and the outer liner 54 is encased within an outer casing 64. An outer flow passage 88 is defined between the outer liner 54 and the outer casing 64, and an inner flow passage 90 is defined between the inner liner 52 and the inner casing 65. Both the outer casing 64 and the inner casing 65 may extend circumferentially about the combustor centerline axis 112. A cold surface side 53 of the inner liner 52 is adjacent to the inner flow passage 90, and a hot surface side 55 of the inner liner 52 is adjacent to the combustion chamber 62. Similarly, a cold surface side 57 of the outer liner 54 is adjacent to the outer flow passage 88, and a hot surface side 59 of the outer liner 54 is adjacent to the combustion chamber 62. The inner liner 52 and the outer liner 54 may extend from the dome assembly 56 to a turbine nozzle 79 (not shown, but depicted numerically) at an entry to the HP turbine 28 (FIG. 1), thus, at least partially defining a hot gas path between the combustor liner 50 and the HP turbine 28. More particularly, the combustion chamber 62 may, more specifically, define a primary combustion zone 74 at which an initial chemical reaction of a fuel-oxidizer mixture 72 occurs to generate combustion gases 86, and/or where recirculation of the combustion gases 86 may occur before the combustion gases 86 flow further downstream to a dilution zone 75. At the dilution zone 75, the combustion gases 86 mix with dilution air 82(*c*) before flowing to a secondary combustion zone 77 and into a turbine nozzle 79 at an entry to the HP turbine 28 and the LP turbine 30. As will be described in more detail below, the plurality of dilution openings 68 and the plurality of dilution openings 69 provide a flow of dilution air 82(*c*) therethrough and into the combustion chamber 62. The flow of dilution air 82(*c*) can thus be utilized to provide quenching of the combustion gases 86 in the dilution zone 75 downstream of the primary combustion zone 74 so as to cool the flow of combustion gases 86 entering the turbine section (28/30).

During operation of the engine 10, as shown in FIGS. 1 and 2 collectively, a volume of air, as indicated schematically by arrows 73, enters the engine 10 from the upstream end 98 through an associated nacelle inlet 76 of the nacelle 44 and/or fan assembly 14. As the air 73 passes across the fan blades 42, a portion of the air 73 is directed or routed into the bypass airflow passage 48 as a bypass airflow 78, while another portion of the air 73 is directed or routed into the LP compressor 22 as a compressor inlet air 80. The compressor inlet air 80 is progressively compressed as it flows through the LP compressor 22 and the HP compressor 24 towards the combustor 26. As shown in FIG. 2, compressed air 82 flows into and pressurizes a diffuser cavity 84. A first portion of the compressed air 82, as indicated schematically by arrows 82(*a*), flows from the diffuser cavity 84 into the pressure plenum 66, where it is mixed by mixer assembly 58 with fuel provided by a fuel nozzle assembly 70. A fuel-oxidizer mixture 72 is then ejected into the combustion chamber 62 by the mixer assembly 58 in a mixer swirl direction 63 about a mixer assembly centerline axis 61. The fuel-oxidizer mixture 72 is ignited and burned to generate the combustion gases 86 within the primary combustion zone 74 of the combustion chamber 62. Typically, the LP compressor 22 and the HP compressor 24 provide more compressed air 82 to the diffuser cavity 84 than is needed for combustion. Therefore, a second portion of the compressed air 82, as indicated schematically by arrows 82(*b*), may be used for various purposes other than combustion. For example, as shown in FIG. 2, compressed air 82(*b*) may be routed into the outer flow passage 88 and generally flows downstream in a flow direction 85 within the outer flow passage 88. Similarly, a portion of the compressed air 82(*b*) may be routed into the inner flow passage 90 and generally flows downstream in a flow direction 87 within the inner flow passage 90. A portion of the compressed air 82(*b*) passing over the dilution openings 68 and passing over the dilution openings 69, shown schematically by arrows 82(*c*), may be routed through the plurality of dilution openings 68 and through the plurality of dilution openings 69, into the dilution zone 75 of combustion chamber 62, to provide quenching of the combustion gases 86 in dilution zone 75. The dilution air 82(*c*) flowing through the plurality of dilution openings 68 and through the plurality of dilution openings 69 may also provide turbulence to the flow of combustion gases 86 so as to provide better mixing of the dilution air 82(*c*) with the combustion gases 86. In addition, or, in the alternative, at least a portion of the compressed air 82(*b*) may be routed out of the diffuser cavity 84 for other purposes, such as to provide cooling air to at least one of the HP turbine 28 or the LP turbine 30.

Referring back to FIGS. 1 and 2 collectively, the combustion gases 86 generated in the combustion chamber 62 flow into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsion at the downstream end 99.

Figure 3:
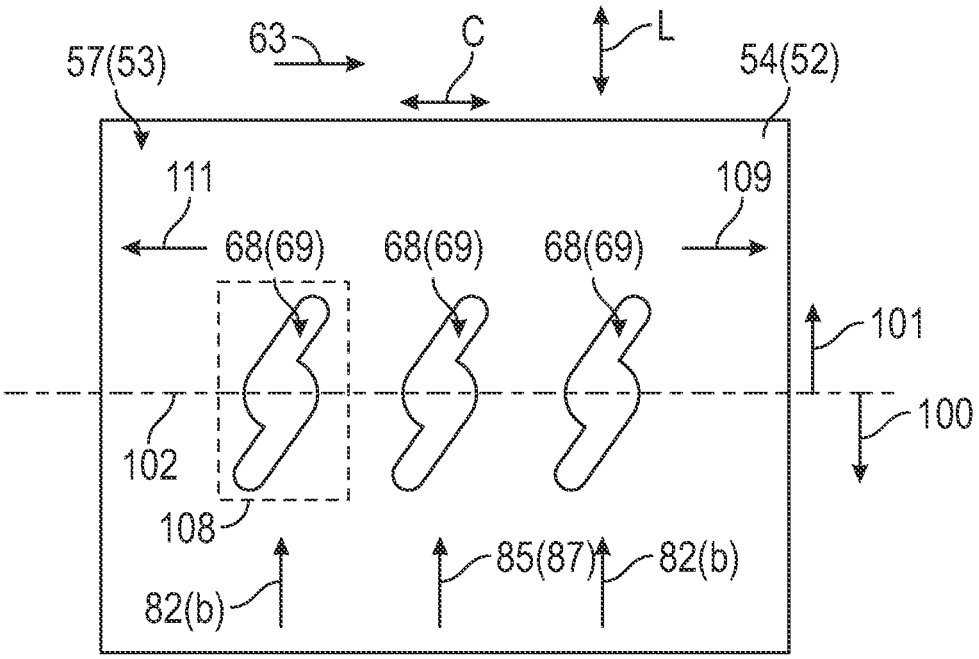
FIG. 3 is a plan view of a portion of a first surface of an outer liner, taken at view A-A of FIG. 2, according to an aspect of the present disclosure.

FIG. 3 is a plan view of a portion of a first surface through the outer liner 54 taken at view A-A of FIG. 2, according to an aspect of the present disclosure. The first surface depicted in FIG. 3 correlates to the cold surface side 57 of the plurality of dilution openings 68. The arrangement of FIG. 3 is equally applicable to the plurality of dilution openings 69 through the inner liner 52 and, therefore, references to the various inner liner elements may be included in the drawings in parentheses. The following description, however, will be made with regard to the elements of the outer liner 54 for brevity. In FIG. 3, the plurality of dilution openings 68 are shown as being spaced apart from one another in a circumferential direction (C). In addition, as shown in FIG. 3, the plurality of dilution openings 68 are arranged along a same longitudinal location 102 in the longitudinal direction (L) of the outer liner 54. The longitudinal location 102 of the plurality of dilution openings 68 may be a given distance 103 (FIG. 2) from, for example, the dome assembly 56. The compressed air 82(*b*) flowing in the flow direction 85 within the outer flow passage 88 flows across the cold surface side 57 of the outer liner 54, and some of the compressed air 82(*b*) flows through each of the plurality of dilution openings 68 into the combustion chamber 62 as the dilution air 82(*c*) (FIG. 2). With reference to the flow direction 85, an upstream direction 100 and a downstream direction 101 are defined along the longitudinal direction (L). Additionally, a first lateral direction 109 and a second lateral direction 111 are defined orthogonal to the longitudinal direction (L).

Figure 4:
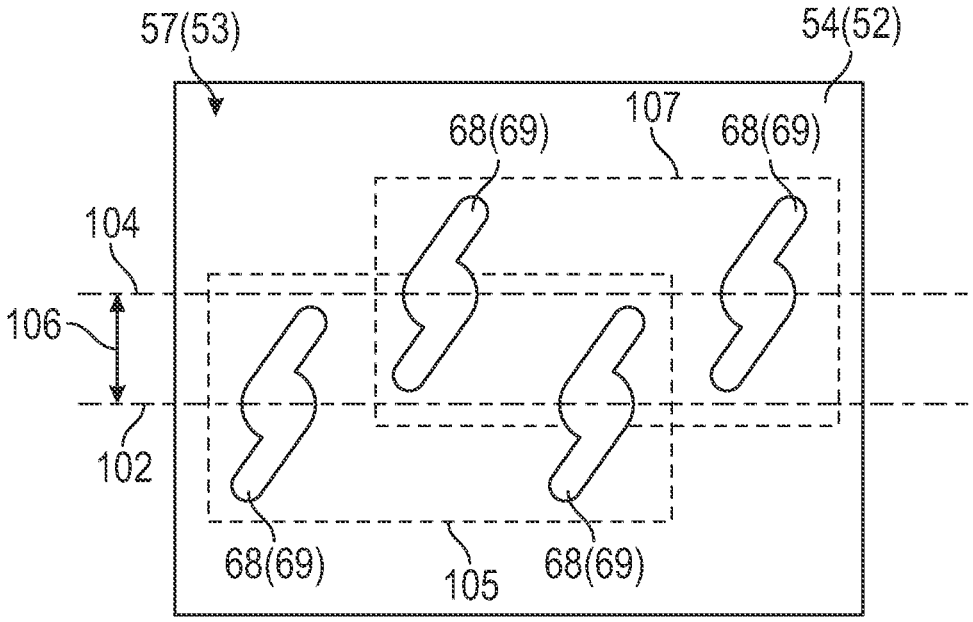
FIG. 4 illustrates an alternative plan view to FIG. 3 of the first surface side of the outer liner, according to another aspect of the present disclosure.

FIG. 4 illustrates an alternative plan view to FIG. 3 of the cold surface side 57 of the plurality of dilution openings 68 through the outer liner 54 according to another aspect of the present disclosure. In contrast to the FIG. 3 aspect in which the plurality of dilution openings 68 are arranged at the same first longitudinal location 102, in the FIG. 4 aspect, a first group 105 of the plurality of dilution openings 68 may be longitudinally staggered with respect to a second group 107 of the plurality of dilution openings 68. For example, the plurality of dilution openings 68 may be alternately staggered such that the first group 105 of the dilution openings 68 are arranged at a first longitudinal location 102, and the second group 107 of the dilution openings 68 may be arranged at a second longitudinal location 104. The first longitudinal location 102 and the second longitudinal location 104 may be offset by a longitudinal spacing 106. In addition, the plurality of dilution openings 68 may have a staggered distance between respective ones of the plurality of dilution openings 68 in the circumferential direction (C) in an alternating arrangement.

Figure 5:
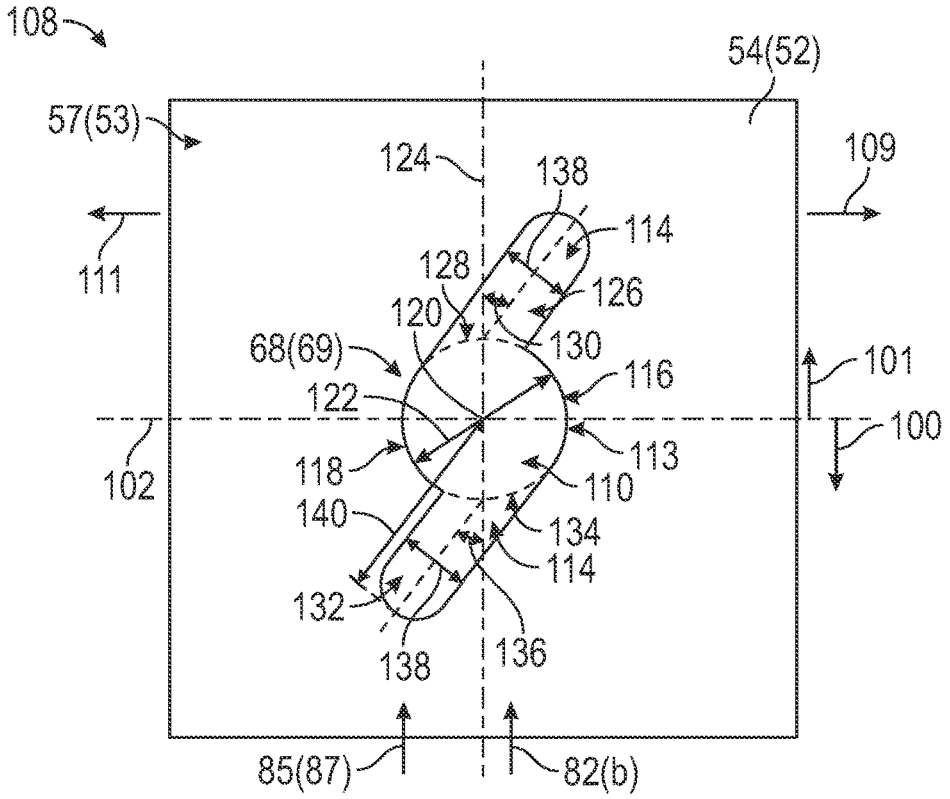
FIG. 5 is an enlarged view of the dilution opening taken at detail view 108 of FIG. 3, according to an aspect of the present disclosure.

FIG. 5 is an enlarged view of the dilution opening 68 taken at detail view 108 of FIG. 3, according to an aspect of the present disclosure. The dilution opening 68 includes a main dilution opening portion 110 defining a main dilution opening perimeter 113, and a plurality of secondary dilution opening portions 114 being arranged about the main dilution opening perimeter 113 and extending outward from the main dilution opening portion 110. In FIG. 5, the main dilution opening perimeter 113 may be seen to correspond to a circumference of the main dilution opening portion 110. The main dilution opening portion 110 is generally the largest portion of the dilution opening 68 and is generally the portion of the dilution opening 68 in which the main dilution jet of dilution air flows therethrough to provide a majority of the dilution effect to the hot combustion gases 86 within the combustion chamber 62. Each of the plurality of secondary dilution opening portions 114, on the other hand, may generally provide a lesser amount of dilution airflow therethrough into the combustion chamber 62 and may generally be arranged to provide a spread of the dilution air outward from the main dilution opening portion 110. In addition, on at least a downstream side of the main dilution opening portion 110, the secondary dilution opening portions 114 may generally be arranged to provide a flow of dilution air near the downstream side of the main dilution opening portion 110 so as to reduce a wake that may otherwise form at the downstream side of the main dilution opening 110. In the FIG. 5 aspect, the main dilution opening portion 110 is seen to be a cylindrical main dilution opening 116 defined by an outer wall 118 having a width defined by an outer wall diameter 122 extending about a centerline axis 120 of the cylindrical main dilution opening 116 through the outer liner 54. While FIG. 5 depicts a cylindrical-shaped main dilution opening as constituting the main dilution opening 116, the main dilution opening 116 is not limited to being a cylindrical-shaped opening and other shapes may be implemented instead. For example, the main dilution opening 116 may be a crescent-shaped opening, a rectangular-shaped opening, a trapezoidal-shaped opening, a hexagonal-shaped opening, or any other type of shaped opening. With respect to the main dilution opening portion 110 being the cylindrical main dilution opening 116, the cylindrical main dilution opening 116 defines a longitudinal direction 124 extending in the upstream direction 100 and the downstream direction 101 with respect to the centerline axis 120, and, along the longitudinal location 102, defines the first lateral direction 109 and the second lateral direction 111 orthogonal to the longitudinal direction 124. In the FIG. 5 aspect, the plurality of secondary dilution opening portions 114 includes a first slotted secondary dilution opening 126 extending outward from a first side 128 (e.g., a downstream side) of the cylindrical main dilution opening 116, and extending in the first lateral direction 109 and also extending in the downstream direction 101. Thus, the first slotted secondary dilution opening 126 extends at a downstream angle 130 with respect to the first lateral direction 109 and the downstream direction 101. The plurality of secondary dilution opening portions 114 of FIG. 5 further include a second slotted secondary dilution opening 132 extending outward from a second side 134 (e.g., an upstream side) opposing the first side 128 of the cylindrical main dilution opening 116, and extending in the second lateral direction 111 and also extending in the upstream direction 100. Thus, the second slotted secondary dilution opening 132 extends at an upstream angle 136 with respect to the second lateral direction 111 and the upstream direction 100. Of course, the dilution opening 68 of FIG. 5 is not limited the configuration as shown, and the dilution opening 68 shown in FIG. 5 may be arranged as a mirror image of that shown in FIG. 5 instead.

The first slotted secondary dilution opening 126 and the second slotted secondary dilution opening 132 may have a slot width 138, where the slot width 138 is less than the width (i.e., diameter) 122 of the cylindrical main dilution opening 116. In addition, the first slotted secondary dilution opening 126 and the second slotted secondary dilution opening 132 may have a slot length 140 with respect to the centerline axis 120. The slot width 138 and the slot length 140 may be arranged to provide a desired amount of dilution airflow therethrough as compared to an amount of dilution airflow provided through the cylindrical main dilution opening 116. For example, an airflow area of the main dilution opening portion 110 may be defined as A(main), while an airflow area of the plurality of secondary dilution opening portions 114 may be defined as A(slot), and an airflow ratio between the A(main) and A(slot) has a range satisfying the following equation (1):

$$A(\text{slot})/A(\text{main})=0.4 \text{ to } 2.0 \qquad \text{Equation (1)}$$

Figure 6:
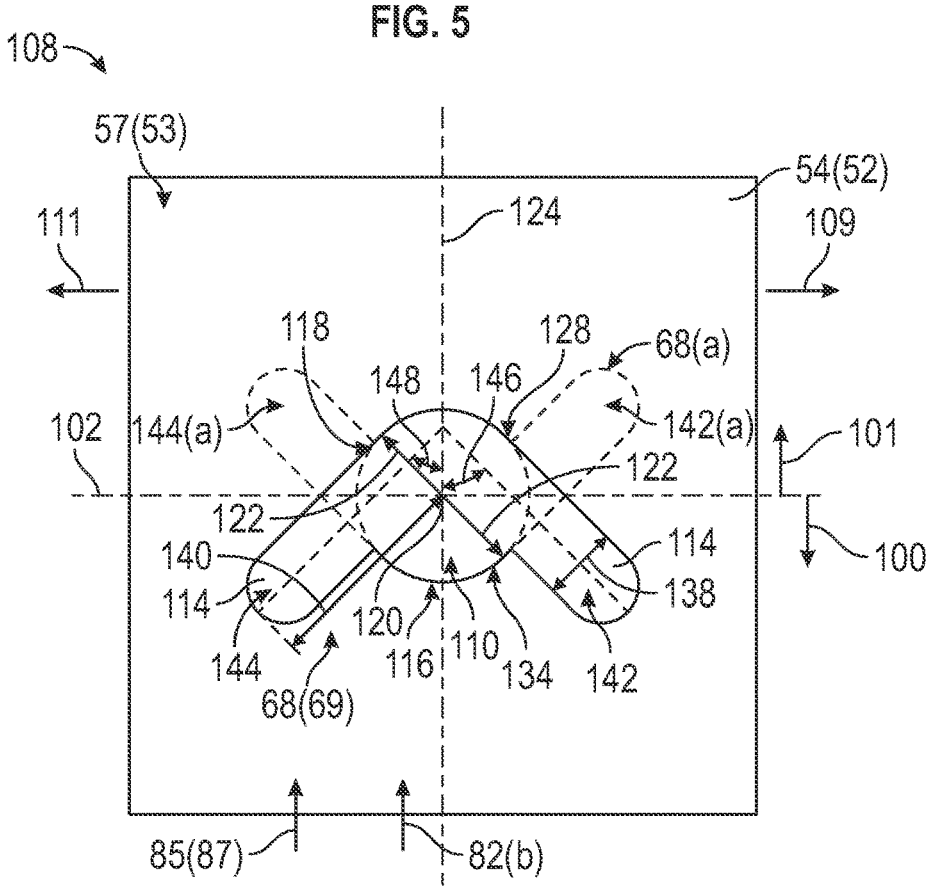
FIG. 6 is an enlarged view of an alternate dilution opening similar to that shown in FIG. 5, according to an aspect of the present disclosure.

FIG. 6 is an enlarged view of an alternate dilution opening 68 similar to that shown in FIG. 5, according to an aspect of the present disclosure. The dilution opening 68 of FIG. 6 also includes the main dilution opening portion 110 and the plurality of secondary dilution opening portions 114. In the FIG. 6 aspect, the main dilution opening portion 110 is the same as that of the FIG. 5 aspect. In the FIG. 6 aspect, however, the plurality of secondary dilution opening portions 114 includes a first slotted secondary dilution opening 142 extending outward from the first (downstream) side 128 of the cylindrical main dilution opening 116, and extending in the first lateral direction 109 and also extending in the upstream direction 100, and a second slotted secondary dilution opening 144 extending outward from the first (downstream) side 128 of the cylindrical main dilution opening 116, and extending in the second lateral direction 111 and also extending in the upstream direction 100. Thus, the first slotted secondary dilution opening 142 may be arranged at an upstream angle 146, and the second slotted secondary dilution opening 144 may be arranged at an upstream angle 148. Both the first slotted secondary dilution opening 142 and the second slotted secondary dilution opening 144 may have the slot width 138 and the slot length 140 such that the airflow ratio A2/A1 of equation (1) is satisfied.

Figure 7:
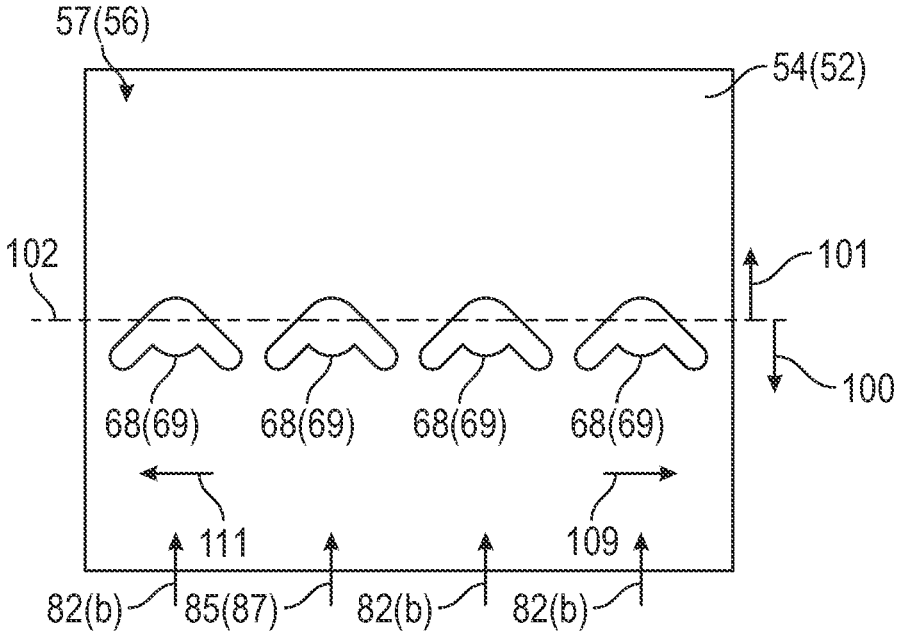
FIG. 7 is an alternate plan view similar to FIG. 3 depicting a circumferential arrangement of a plurality of dilution openings, according to an aspect of the present disclosure.
Figure 8:
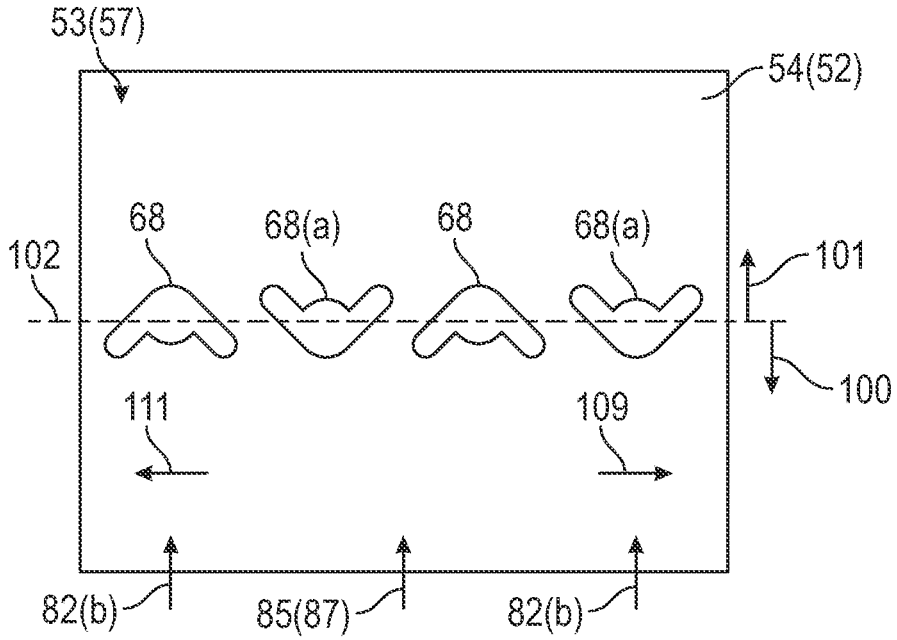
FIG. 8 is another alternate plan view depicting another circumferential arrangement of a plurality of dilution openings, according to an aspect of the present disclosure.

FIG. 7 is an alternate plan view similar to FIG. 3 depicting a circumferential arrangement of a plurality of the FIG. 6 dilution openings 68 in circumferential arrangement with one another. FIG. 8 is another alternate plan view similar to FIG. 7, but depicts an aspect where the dilution opening 68 of FIG. 6 may be reverse oriented so as to define a reverse oriented dilution opening 68(*a*). Referring back to FIG. 6, the reverse oriented dilution opening 68(*a*) may simply be the dilution opening 68 of FIG. 6 in which the dilution opening 68 in FIG. 6 is rotated one-hundred-eighty degrees about the centerline axis 120. Thus, the reverse oriented dilution opening 68(*a*) may include the cylindrical main dilution opening 116, with a first slotted secondary dilution opening 142(*a*) extending outward from the second side (i.e., upstream side) 134 in the first lateral direction 109 and in the downstream direction 101, and a second slotted secondary dilution opening 144(*a*) extending outward from the second (upstream) side 134 in the second lateral direction 111 and in the downstream direction 101. As shown in FIG. 8, the dilution opening 68 and the reverse oriented dilution opening 68(*a*) may be arranged in alternating circumferential arrangement along the longitudinal location 102. Of course, the dilution opening 68 and the reverse dilution opening 68(*a*) in FIG. 8 may also be arranged with a longitudinal offset similar to that shown in FIG. 4, where the dilution openings 68 may be arranged at the longitudinal location 102 and the reverse oriented dilution openings 68(*a*) may be arranged at the second longitudinal location 104 (FIG. 4).

Figure 9:
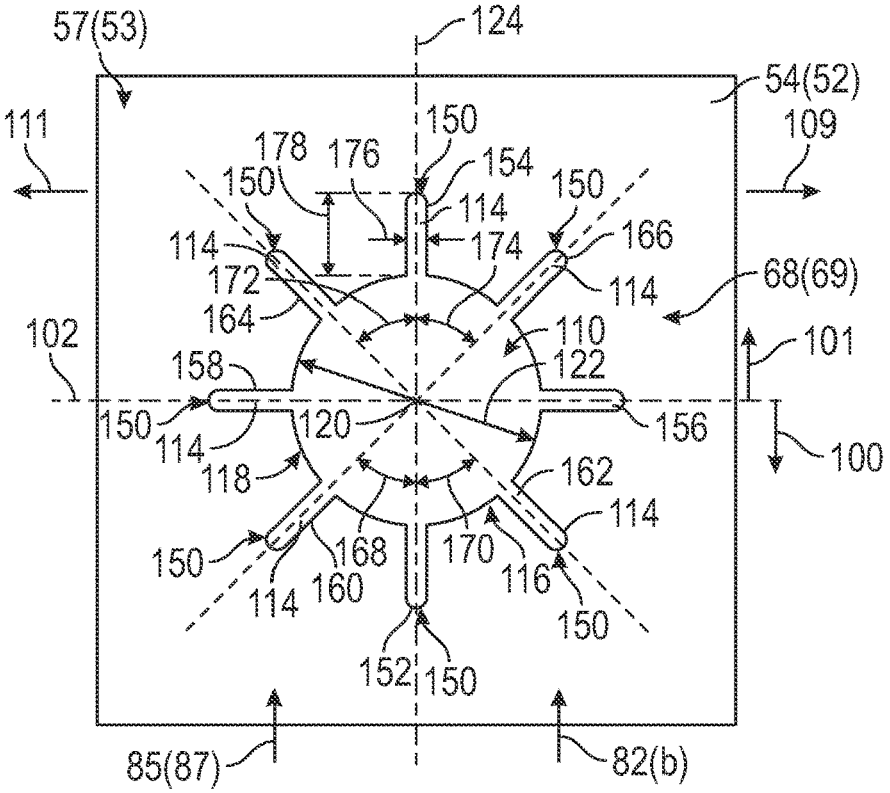
FIG. 9 is an enlarged view of another alternate dilution opening, according to another aspect of the present disclosure.

FIG. 9 is an enlarged view of another alternate dilution opening 68, according to another aspect of the present disclosure. The dilution opening 68 of FIG. 9 includes the main dilution opening portion 110 and the plurality of secondary dilution opening portions 114. In the FIG. 9 aspect, the main dilution opening portion 110 is the depicted as being the same as that of the FIG. 5 aspect in that the main dilution opening portion 110 may be the cylindrical main dilution opening 116 defined by the outer wall 118 having the width (diameter) 122. The cylindrical main dilution opening 116 is merely one example of the main dilution opening portion 110, and other shapes may be implemented instead, as was discussed above. In the FIG. 9 aspect, however, the plurality of secondary dilution opening portions 114 includes a plurality of slit openings 150 extending outward from the outer wall 118 that defines the cylindrical main dilution opening 116. The slit openings 150 may differ from the first slotted secondary dilution opening 142 in that the slit openings 150 may have a slit width (discussed below) that is significantly less than the slot width 138 of the first slotted secondary dilution opening 142. For example, the slit width may range from ten percent to fifty percent of the slot width 138. However, the slit openings 150 may have a slit length (discussed below) that may be equal to, less than, or greater than the slot length 140 of the first slotted secondary dilution opening 142. The plurality of slit openings 150 may include a first slit opening 152 extending in the upstream direction 100, a second slit opening 154 extending in the downstream direction 101, a third slit opening 156 extending in the first lateral direction 109, and a fourth slit opening 158 extending in the second lateral direction 111. In addition, the plurality of slit openings 150 may include a fifth slit opening 160 extending in the upstream direction 100 and in the second lateral direction 111 at an upstream angle 168, and a sixth slit opening 162 extending in the upstream direction 100 and in the first lateral direction 109 at an upstream angle 170. Further, the plurality of slit openings 150 may include a seventh slit opening 164 extending in the downstream direction 101 and in the second lateral direction 111 at a downstream angle 172, and an eighth slit opening 166 extending in the downstream direction 101 and in the first lateral direction 109 at a downstream angle 174.

In the illustrated figure, each of the plurality of slit openings 150 is shown as having a same slit width 176 and a same slit length 178 from the outer wall 118. However, this need not be the case. The slit width(s) 176 and the slit length(s) 178 may be arranged to provide a desired amount of dilution airflow therethrough as compared to an amount of dilution airflow provided through the cylindrical main dilution opening 116. For example, an airflow area of the main dilution opening portion 110 may be defined as A(main), while an airflow area of the plurality of slit openings 150 may be defined as A(slit), and an airflow ratio between A(main) and A(slit) has a range satisfying the following equation (2):

$$A(\text{slit})/A(\text{main})=0.1 \text{ to } 1.0 \qquad \text{Equation (2)}$$

Figure 10:
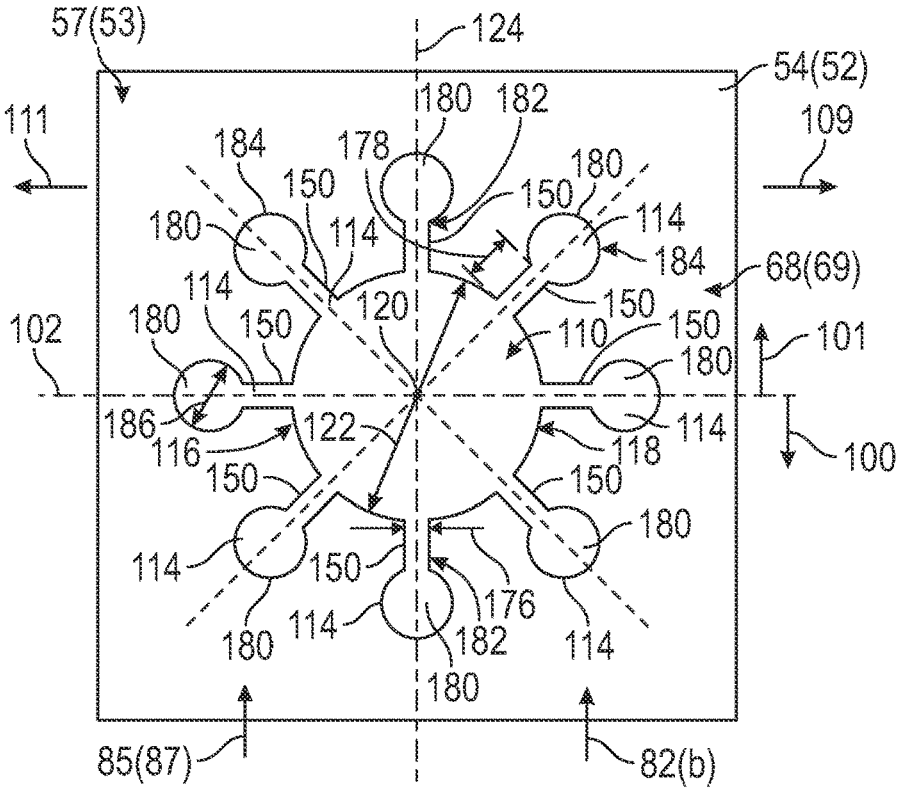
FIG. 10 is an enlarged view of still another alternate dilution opening, according to another aspect of the present disclosure.

FIG. 10 is an enlarged view of still another alternate dilution opening 68, according to another aspect of the present disclosure. The dilution opening 68 of FIG. 10 includes the main dilution opening portion 110 and the plurality of secondary dilution opening portions 114. In the FIG. 10 aspect, the main dilution opening portion 110 is the same as that of the FIG. 9 aspect in that the main dilution opening portion 110 comprises the cylindrical main dilution opening 116 defined by the outer wall 118 having the diameter 122. In the FIG. 10 aspect, the plurality of secondary dilution opening portions 114 also includes the slit openings 150 extending outward from the outer wall 118 that defines the cylindrical main dilution opening 116, similar to the FIG. 9 aspect. In the FIG. 10 aspect, however, each of the plurality of secondary dilution opening portions 114 includes a tertiary dilution portion 180 arranged at an outer end 182 of the slit opening 150. In the FIG. 10 aspect, each of the tertiary dilution portions 180 is a shown as constituting a cylindrical tertiary dilution opening 184 that extends through the outer liner 54. Of course, the tertiary dilution openings 184 need not be cylindrical shaped and may be other shapes instead, and the cylindrical shaped opening depicted in FIG. 10 is merely one example of a tertiary dilution opening. A width (e.g., diameter) 186 of the cylindrical tertiary dilution opening 180 is less that the width (diameter) 122 of the cylindrical main dilution opening 116. The slit width 176 and the slit length 178 of each of the slit openings 150, along with the width (diameter) 186 of each cylindrical tertiary dilution opening 184, and the width (diameter) 122 of the cylindrical main dilution opening 116 are such that the airflow ratio A4/A3 of equation (2) is satisfied. While each of the plurality of secondary dilution opening portions 114 is illustrated as including the tertiary dilution portion 180, it should be understood that this need not be the case. Further still, while each of the tertiary dilution portions 180 have been illustrated as having the same size and shape, this also need not be the case. Further, while the example in FIG. 10 is illustrated as being symmetrical or mirrored about a centerline, this also need not be the case.

Figure 11:
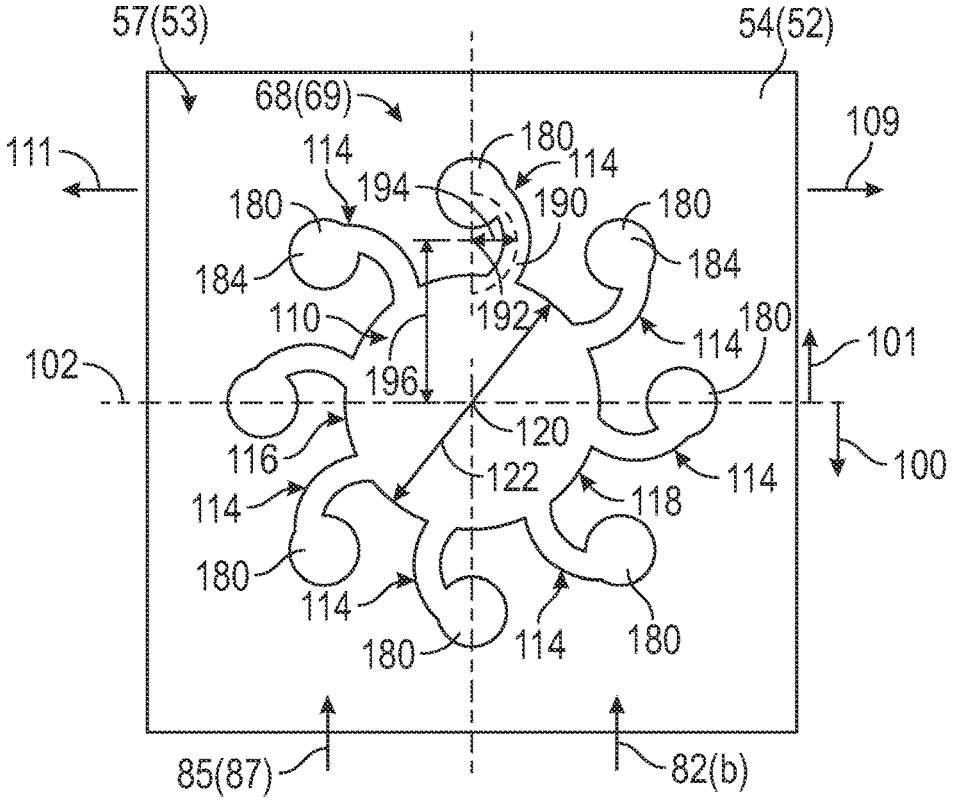
FIG. 11 is an enlarged view of yet another alternate dilution opening, according to another aspect of the present disclosure.

FIG. 11 is an enlarged view of yet another alternate dilution opening 68, according to another aspect of the present disclosure. The dilution opening 68 of FIG. 11 includes the main dilution opening portion 110 and the plurality of secondary dilution opening portions 114. In the FIG. 11 aspect, the main dilution opening portion 110 is the same as that of the FIG. 9 and FIG. 10 aspects in that the main dilution opening portion 110 comprises the cylindrical main dilution opening 116 defined by the outer wall 118 having the diameter 122. In the FIG. 11 aspect, the plurality of secondary dilution opening portions 114 includes a plurality of curved slit openings 188 extending outward from the outer wall 118 rather than the straight slit openings 150. The curved slit openings 188 may be defined by an arc 190 having a radius 194 from an arc center 192, where the arc center 192 is located at a radial distance 196 from the centerline axis 120 of the cylindrical main dilution opening 116. The arc 190 need not be the same for each of the curved slit openings 188. In addition, the curved slit openings 188 need not be a circular arc segment, but may have other shapes instead, including a parabolic shape, or an S-shape. The FIG. 11 aspect includes the cylindrical tertiary dilution opening 184, similar to the FIG. 10 aspect. The FIG. 11 arrangement also satisfies the airflow ratio A4/A3 of equation (2).

Figure 12:
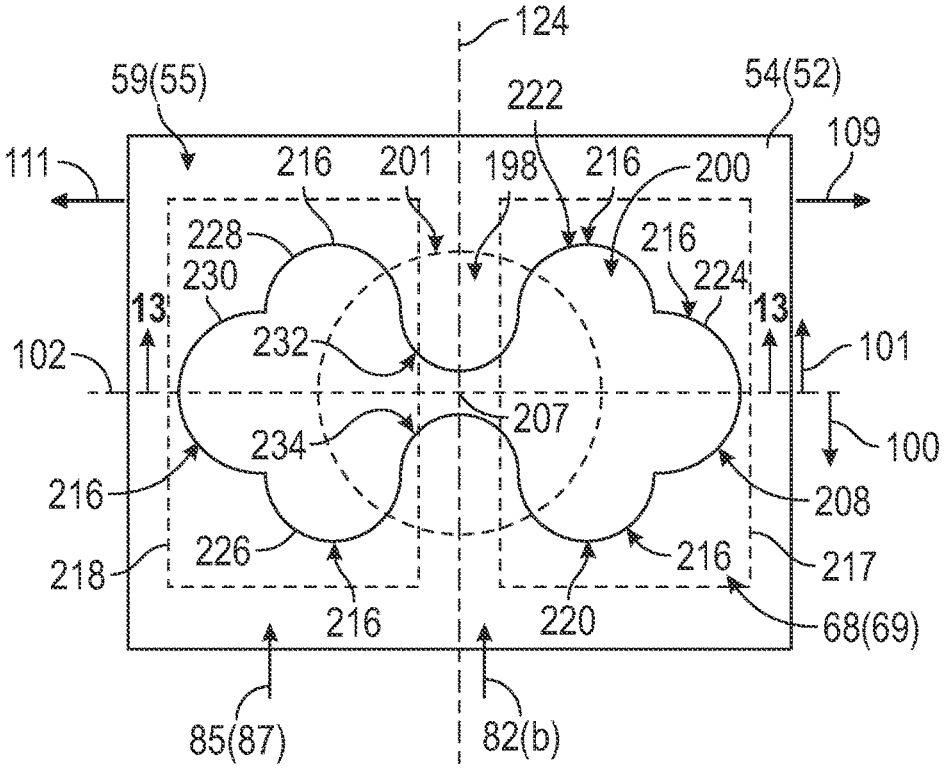
FIG. 12 is a plan view of a portion of the hot surface side of a dilution opening through a portion of the outer liner taken at view B-B of FIG. 2, according to an aspect of the present disclosure.
Figure 13:
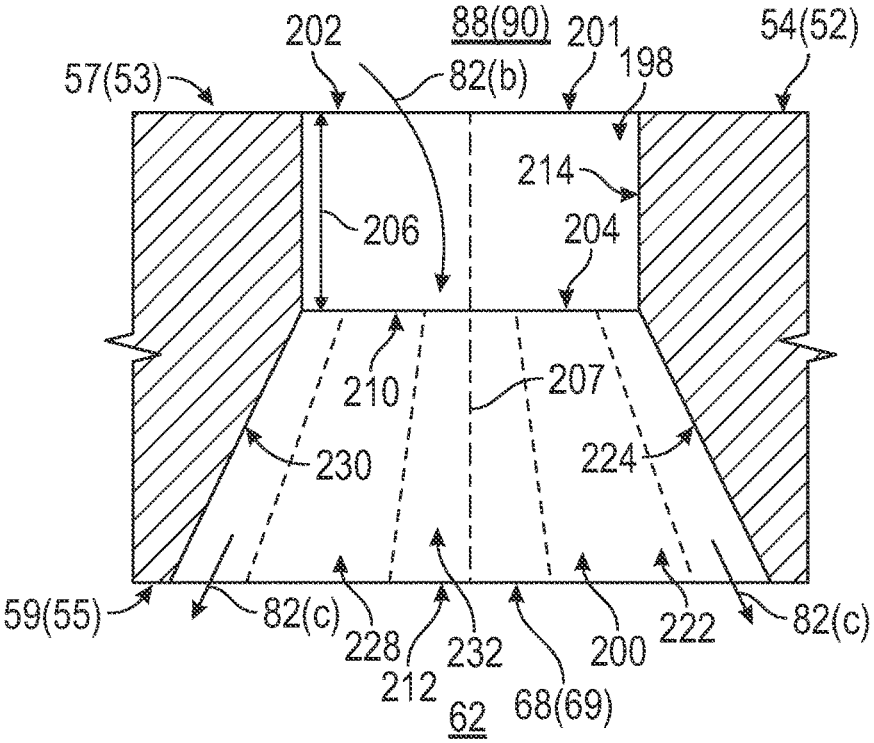
FIG. 13 is a partial cross-sectional view of the dilution opening taken at plane 13-13 of FIG. 12, according to an aspect of the present disclosure.

FIG. 12 is a plan view of a portion of the hot surface side 59 of a dilution opening 68 through a portion of the outer liner 54 taken at view B-B of FIG. 2, according to an aspect of the present disclosure. FIG. 13 is a partial cross-sectional view of the dilution opening 68 taken at plane 13-13 of FIG. 12. As shown in FIG. 13, the dilution opening 68 includes a main dilution opening portion 198 and a secondary dilution opening portion 200 that are arranged in series from the a first surface side of the outer liner 54, which may be the cold surface side 57 of the outer liner 54, to a second surface side of the outer liner 54, which may be the hot surface side 59 of the outer liner 54. As seen in FIGS. 12 and 13, the main dilution opening portion 198 may be a cylindrical main dilution opening 201 defined by an outer wall 214 extending about a centerline axis 207 of the cylindrical main dilution opening 201. Of course, as with the previous aspects described above, the main dilution opening portion 198 need not be a cylindrical opening and other shapes may be implemented instead. The cylindrical main dilution opening 201 defines the longitudinal direction 124 extending in the upstream direction 100 and in the downstream direction 101 with respect to the centerline axis 207, and the first lateral direction 109 and the second lateral direction 111 orthogonal to the longitudinal direction 124. A first end 202 of the main dilution opening portion 198 is arranged at the first (cold) surface side 57 of the outer liner 54 and a second end 204 of the main dilution opening portion 198 is arranged within the outer liner 54 a distance 206 between the first (cold)

surface side 57 of the outer liner 54 and the second (hot) surface side 59 of the outer liner 54.

As shown in FIG. 12, the secondary dilution opening portion 200 defines a lobe structure 208. A lobe structure may be outward extensions of an opening through the liner such that the outlet end of the opening has a larger area than an inlet end of the opening, and the outlet end may also have a different geometric profile than that of the inlet end. The lobe structure 208 is shown to include a plurality of lobes 216 at the hot surface side 59 of the outer liner 54, where a first end 210 of the secondary dilution opening portion 200 is arranged at the second end 204 of the main dilution opening portion 198 and a second end 212 of the secondary dilution opening portion 200 is arranged at the hot surface side 59 of the outer liner 54. The lobe structure 208 includes a first lobe structure portion 217 on a first side (e.g., in the first lateral direction 109) of the centerline axis 207, and a second lobe structure portion 218 on a second side (e.g., in the second lateral direction 111) of centerline axis 207. The first lobe structure portion 217 includes a first lobe 220 extending in a first longitudinal direction (e.g., in the upstream direction 100), a second lobe 222 extending in a second longitudinal direction opposite the first longitudinal direction (e.g., in the downstream direction 101), and a third lobe 224 extending in the first lateral direction 109. Similarly, the second lobe structure portion 218 includes a fourth lobe 226 extending in the first longitudinal direction (i.e., in the upstream direction 100), a fifth lobe 228 extending in the second longitudinal direction (i.e., in the downstream direction 101), and a sixth lobe 230 extending in the second lateral direction 111. A first connecting lobe 232 extends in the first longitudinal direction (i.e., in the upstream direction 100) and is connected with the second lobe 222 of the first lobe structure portion 217 and the fifth lobe 228 of the second lobe structure portion 218, and a second connecting lobe 234 extends in the second longitudinal direction (i.e., in the downstream direction 101) and is connected with the first lobe 220 of the first lobe structure portion 217 and with the fourth lobe 226 of the second lobe structure portion 218. Each of the lobes 216 may be generally conical shaped walls, with a base of the conical shaped wall being arranged at the second (hot) side surface 59 of the outer liner 54. Of course, the lobes 216 need not be constituted of conical shaped walls and may be defined by other shapes instead, such as pyramidal shaped walls, or contoured walls.

Similar to the above aspects of FIGS. 3 to 11, the FIG. 12 aspect may provide for a particular airflow ratio. For example, an airflow area of the main dilution opening portion 198 may be defined as A(main), while an airflow area of the lobe structure 208 may be defined as A(lobe), and an airflow ratio between A(main) and A(lobe) has a range satisfying the following equation (3):

$$A(\text{lobe})/A(\text{main})=0.5 \text{ to } 1.0 \qquad \text{Equation (3)}$$

Figure 14:
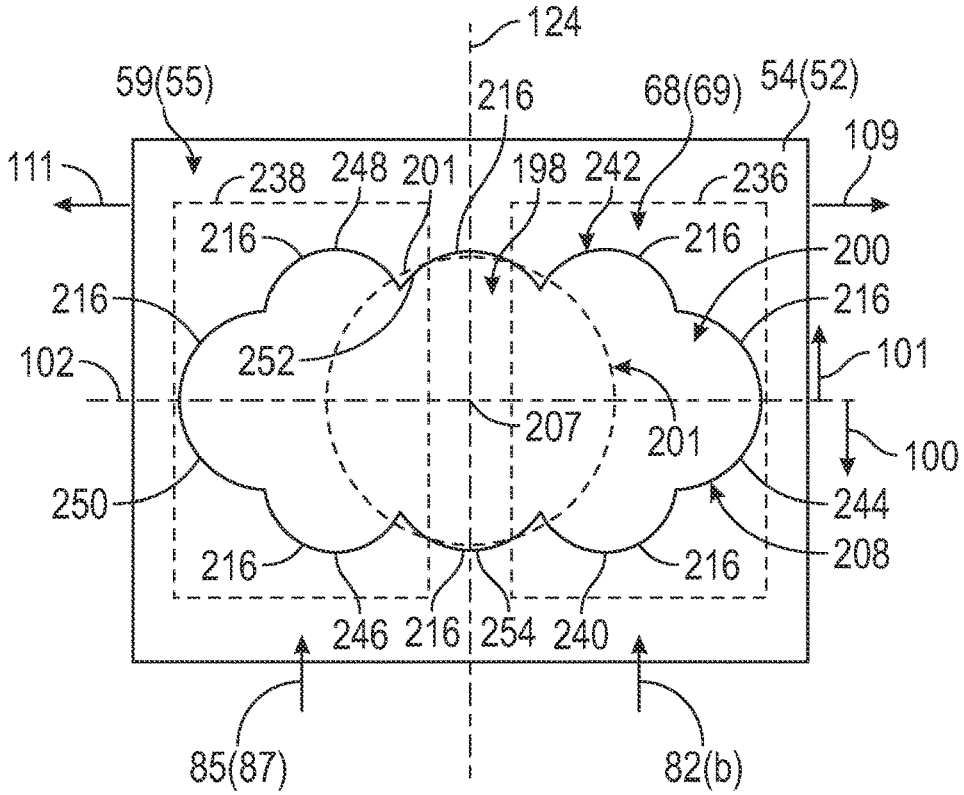
FIG. 14 is a plan view of a portion of the hot surface side of an alternate dilution opening through a portion of the outer liner, according to an aspect of the present disclosure.

FIG. 14 is a plan view of a portion of the first (hot) surface side 59 of an alternate dilution opening 68 through a portion of the outer liner 54, according to an aspect of the present disclosure. The FIG. 14 aspect is similar to the FIG. 12 aspect in that it includes the main dilution opening portion 198 and the secondary dilution opening portion 200, but includes an alternate lobe structure 208. Similar to the FIG. 12 aspect, the FIG. 14 aspect includes a first lobe structure portion 236 and a second lobe structure portion 238. The first lobe structure portion 236 includes a first lobe 240 extending in the first longitudinal direction (i.e., in the upstream direction 100), a second lobe 242 extending in the second longitudinal direction (i.e., in the downstream direction 101), and a third lobe 244 extending in the first lateral direction 109. The second lobe structure portion 238 includes a fourth lobe 246 extending in the first longitudinal direction (i.e., in the upstream direction 100), a fifth lobe 248 extending in the second longitudinal direction (i.e., in the downstream direction 101), and a sixth lobe 250 extending in the second lateral direction 111. A first connecting lobe 252 extends in the second longitudinal direction (i.e., in the downstream direction 101) and connects the second lobe 242 of the first lobe structure portion 236 with the fifth lobe 248 of the second lobe structure portion 238, and a second connecting lobe 254 extends in the first longitudinal direction (i.e., in the upstream direction 100) and connects the first lobe 240 of the first lobe structure portion 236 with the fourth lobe 246 of the second lobe structure portion 238.

Figure 15:
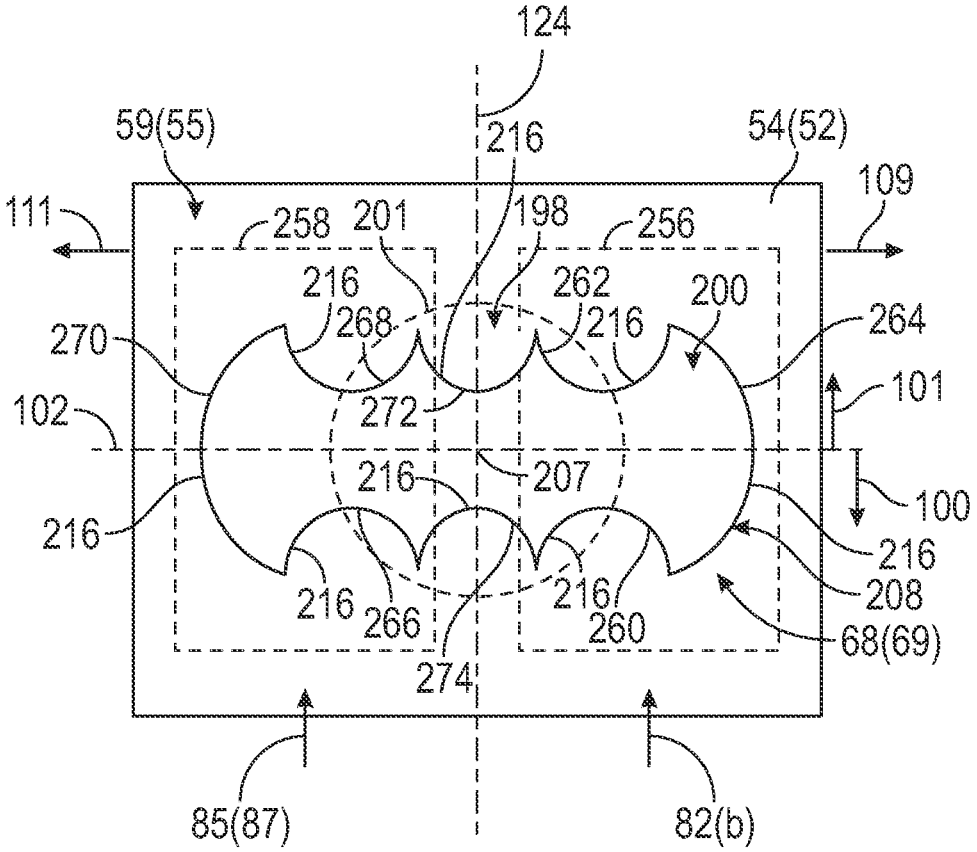
FIG. 15 is a plan view of a portion of the hot surface side of another alternate dilution opening through a portion of the outer liner, according to an aspect of the present disclosure.

FIG. 15 is a plan view of a portion of the second (hot) surface side 59 of another alternate dilution opening 68 through a portion of the outer liner 54, according to an aspect of the present disclosure. The FIG. 15 aspect is similar to the FIG. 12 aspect and the FIG. 14 aspect in that it includes the main dilution opening portion 198 and the secondary dilution opening portion 200, but includes another alternate lobe structure 208. Similar to the FIG. 12 aspect and the FIG. 14 aspect, the FIG. 15 aspect includes a first lobe structure portion 256 and a second lobe structure portion 258. The first lobe structure portion 256 includes a first lobe 260 extending in the second longitudinal direction (i.e., in the downstream direction 101), a second lobe 262 extending in the first longitudinal direction (i.e., in the upstream direction 100), and a third lobe 264 extending in the first lateral direction 109. The second lobe structure portion 258 includes a fourth lobe 266 extending in the second longitudinal direction (i.e., in the downstream direction 101), a fifth lobe 268 extending in the first longitudinal direction (i.e., in the upstream direction 100), and a sixth lobe 270 extending in the second lateral direction 111. A first connecting lobe 272 extends in the first longitudinal direction (i.e., in the upstream direction 100) and connects the second lobe 262 of the first lobe structure portion 256 with the fifth lobe 268 of the second lobe structure portion 258, and a second connecting lobe 274 extends in the second longitudinal direction (i.e., in the downstream direction 101) and connects the first lobe 260 of the first lobe structure portion 256 with the fourth lobe 266 of the second lobe structure portion 258.

Figure 16:
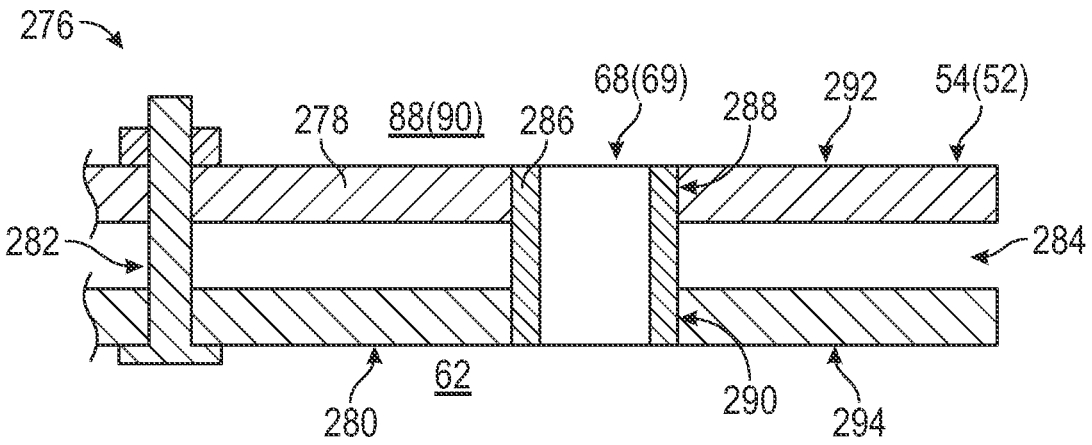
FIG. 16 is an enlarged cross-sectional view of an alternate liner and dilution opening arrangement, taken at detail view 276 of FIG. 2, according to an aspect of the present disclosure.
Figure 17:
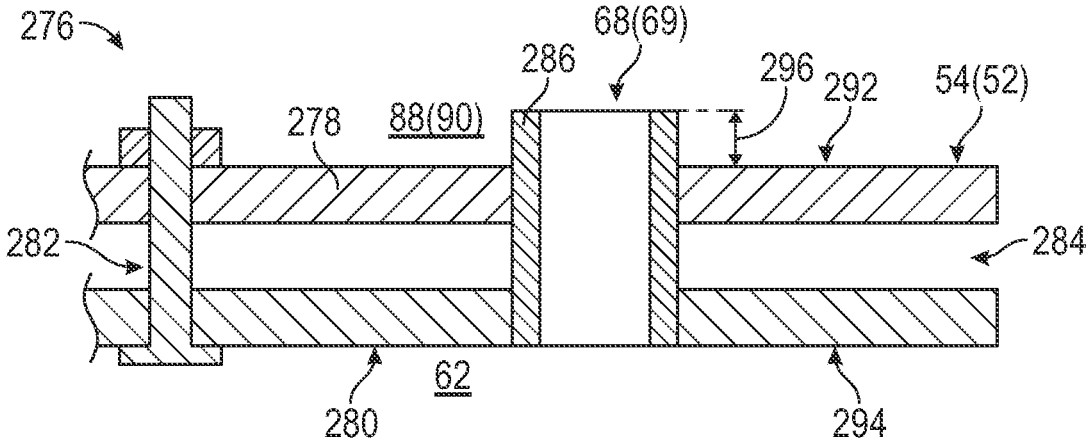
FIG. 17 is an enlarged cross-sectional view of another alternate liner and dilution opening arrangement, according to an aspect of the present disclosure.
Figure 18:
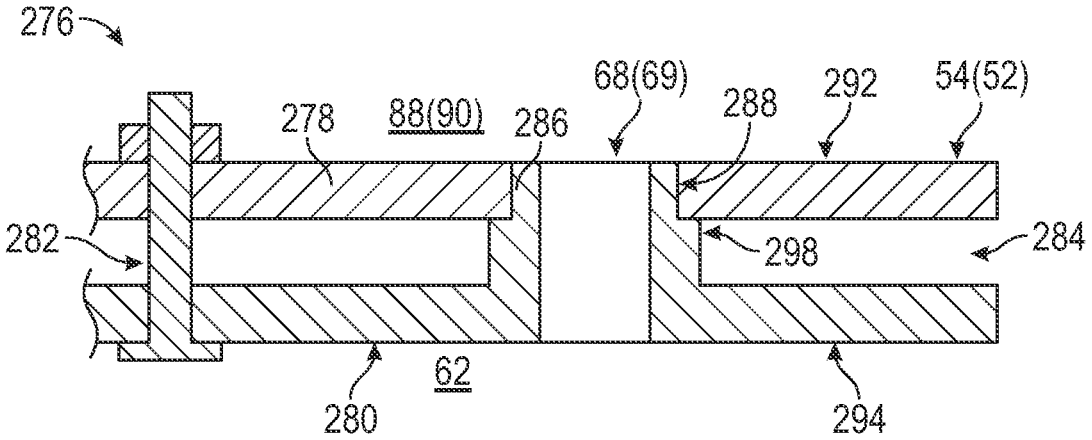
FIG. 18 is an enlarged cross-sectional view of an yet another alternate liner and dilution opening arrangement, according to another aspect of the present disclosure.

Each of the foregoing aspects of the dilution opening 68 has been described with regard to the dilution opening 68 being integral with the outer liner 54. However, the plurality of dilution openings 68, and the plurality of dilution openings 69, may be implemented within an insert or a grommet that may be installed in the outer liner 54 or the inner liner 52. In addition, while a single layer outer liner 54 has been described above, the dilution openings 68 may also be implemented in multi-layer liners. FIGS. 16 to 18 depict examples, taken at detail view 276 of FIG. 2, where the dilution opening 68 may be implemented as a grommet in a multi-layer liner. In FIG. 16, outer liner 54 is shown to include an outer shell 278 and an inner panel 280 that may be connected together by a connector 282, such as via a bolted connection, to define a cavity 284 therebetween. The dilution opening 68 is implemented as a grommet 286 that may be inserted through an outer shell opening 288 in the outer shell 278 and through an inner panel opening 290 through the inner panel 280. The outer shell 278 includes an outer shell cold surface side 292 and the inner panel 280 includes an inner panel hot surface side 294, and the grommet 286 may be arranged to extend from the outer shell cold surface side 292 to the inner panel hot surface side 294.

In an alternative arrangement of the grommet 286 as shown in FIG. 17, the grommet 286 may be arranged to extend a height 296 from the outer shell cold surface side 292 into the outer flow passage 88. In another example depicted in FIG. 18, the grommet 286 may be formed integral with the inner panel 280, and may include a shoulder 298, which may function as a spacer between the outer shell 278 and the inner panel 280. Of course, the grommet 286 could be formed integral with the outer shell 278 instead. Any of the dilution opening 68 aspects depicted in FIGS. 3 to 15 may be implemented in the grommet 286.

While the foregoing description relates generally to a gas turbine engine, the gas turbine engine may be implemented in various environments. For example, the engine may be implemented in an aircraft, but may also be implemented in non-aircraft applications, such as power generating stations, marine applications, or oil and gas production applications. Thus, the present disclosure is not limited to use in aircraft.

Each of the foregoing arrangements of dilution openings through the liner provide for a better spread of the dilution air within the combustion chamber. In particular, a better spread of the dilution air about the downstream side of the main dilution opening can be achieved so as to reduce the wake that otherwise may occur at the downstream side of the dilution opening. In addition, a better spread of the dilution air laterally from the dilution opening can be achieved so as to provide for better mixing of the dilution air with the combustion gases in the combustion chamber, thereby reducing $NO_x$ emissions.

Further aspects of the present disclosure are provided by the subject matter of the following clauses.

A combustor liner for a gas turbine, the combustor liner including a liner at least partially defining a combustion chamber, wherein the liner includes a plurality of dilution openings therethrough, at least one dilution opening of the plurality of dilution openings defined by (a) a main dilution opening portion defining a main dilution opening perimeter, and (b) a plurality of secondary dilution opening portions arranged about the main dilution opening perimeter and extending outward from the main dilution opening portion.

The combustor liner according to the preceding clause, wherein the main dilution opening perimeter is defined by an outer wall extending about a centerline axis of the main dilution opening through the liner, the main dilution opening defining a longitudinal direction extending in an upstream direction and a downstream direction with respect to the centerline axis, a first lateral direction orthogonal to the longitudinal direction, and a second lateral direction orthogonal to the longitudinal direction, the plurality of secondary dilution opening portions comprises a first slotted secondary dilution opening extending outward from the a downstream side of the main dilution opening and extending in the first lateral direction and in the upstream direction, and a second slotted secondary dilution opening extending outward from the downstream side of the main dilution opening in the second lateral direction and in the upstream direction.

The combustor liner according to any preceding clause, wherein an airflow ratio between the main dilution opening portion and the plurality of secondary dilution opening portions is defined by: A(slot)/A(main)=0.4 to 2.0, where A(slot) is the airflow area of the plurality of secondary dilution opening portions, and A(main) is the airflow area of the main dilution opening portion.

The combustor liner according to any preceding clause, wherein the plurality of secondary dilution opening portions comprises a plurality of slit openings extending outward from an outer wall defining the main dilution opening perimeter.

The combustor liner according to any preceding clause, wherein an airflow ratio between the main dilution opening portion and the plurality of slit openings has a range defined by: A(slit)/A(main)=0.1 to 1.0, where, A(slit) is the airflow area of the plurality of slit openings, and A(main) is the airflow area of the main dilution opening portion.

The combustor liner according to any preceding clause, wherein the plurality of slit openings are curved slit openings extending from the outer wall.

The combustor liner according to any preceding clause, wherein the at least one dilution opening further includes at least one tertiary dilution portion arranged at an outer end of at least one of the plurality of slit openings.

The combustor liner according to any preceding clause, wherein the plurality of slit openings extend radially outward from the outer wall with respect to a centerline axis of the main dilution opening, and a width of the tertiary dilution portion is smaller than a width of the main dilution opening.

The combustor liner according to any preceding clause, wherein the tertiary dilution portion comprises a cylindrical tertiary dilution opening extending through the liner.

The combustor liner according to any preceding clause, wherein at least one of the plurality of slit openings is a curved slit opening extending from the outer wall, and a width of the tertiary dilution portion is smaller than a width of the main dilution opening.

The combustor liner according to any preceding clause, wherein the tertiary dilution portions comprises a cylindrical tertiary opening extending through the liner.

The combustor liner according to any preceding clause, wherein the main dilution opening perimeter is defined by an outer wall extending about a centerline axis of the main dilution opening through the liner, the main dilution opening defining a longitudinal direction extending in an upstream direction and a downstream direction with respect to the centerline axis, a first lateral direction orthogonal to the longitudinal direction, and a second lateral direction orthogonal to the longitudinal direction, the at least one of the plurality of secondary dilution opening portions comprises a first slotted secondary dilution opening extending outward from the a downstream side of the main dilution opening in the first lateral direction and in the downstream direction, and a second slotted secondary dilution opening extending outward from an upstream side of the main dilution opening in the second lateral direction and in the upstream direction.

The combustor liner according to any preceding clause, wherein the first slotted secondary dilution opening extends at a downstream angle with respect to the first lateral direction and the downstream direction, and the second slotted secondary dilution opening extends at an upstream angle with respect to the second lateral direction and the upstream direction.

The combustor liner according to any preceding clause, wherein a slot width of the first slotted secondary dilution opening is less than a width of the main dilution opening, and a slot width of the second slotted secondary dilution opening is less than the width of the main dilution opening.

The combustor liner according to any preceding clause, wherein the main dilution opening portion and the at least one of the plurality of secondary dilution opening portions are arranged in series from a first surface side of the liner to a second surface side of the liner, a first end of the main dilution opening portion being arranged at the first surface side of the liner and a second end of the main dilution opening portion being arranged within the liner between the first surface side of the liner and the second surface side of the liner, and a first end of the at least one of the plurality of secondary dilution opening portions being arranged at the second end of the main dilution opening portion and a second end of the at least one of the plurality of secondary dilution opening portions being arranged at the second surface side of the liner.

The combustor liner according to any preceding clause, wherein the at least one of the plurality of secondary dilution opening portions defines a lobe structure having a plurality of lobes at the second surface side of the liner.

The combustor liner according to any preceding clause, wherein the main dilution opening portion is defined by an outer wall extending about a centerline axis of the main dilution opening through the liner, the main dilution opening defining a longitudinal direction extending in a first longitudinal direction and a second longitudinal direction opposite the first longitudinal direction with respect to the centerline axis, and a first lateral direction orthogonal to the longitudinal direction, and a second lateral direction orthogonal to the longitudinal direction, the lobe structure comprises a first lobe structure portion on a first side of the centerline axis, and a second lobe structure portion on a second side of the centerline axis.

The combustor liner according to any preceding clause, wherein the first lobe structure portion includes a first lobe extending in the first longitudinal direction, a second lobe extending in the second longitudinal direction, and a third lobe extending in the first lateral direction, and the second lobe structure portion includes a fourth lobe extending in the first longitudinal direction, a fifth lobe extending in the second longitudinal direction, and a sixth lobe extending in the second lateral direction, a first connecting lobe extends in the first longitudinal direction and is connected with the second lobe of the first lobe structure portion and the fifth lobe of the second lobe structure portion, and a second connecting lobe extends in the second longitudinal direction and is connected with the first lobe of the first lobe structure portion and with the fourth lobe of the second lobe structure portion.

The combustor liner according to any preceding clause, wherein the first lobe structure portion includes a first lobe extending in the first longitudinal direction, a second lobe extending in the second longitudinal direction, and a third lobe extending in the first lateral direction, and the second lobe structure portion includes a fourth lobe extending in the first longitudinal direction, a fifth lobe extending in the second longitudinal direction, and a sixth lobe extending in the second lateral direction, a first connecting lobe extends in the second longitudinal direction and is connected with the first lobe of the first lobe structure portion and the fifth lobe of the second lobe structure portion, and a second connecting lobe extends in the first longitudinal direction and is connected with the first lobe of the first lobe structure portion and with the fourth lobe of the second lobe structure portion.

The combustor liner according to any preceding clause, wherein the first lobe structure portion includes a first lobe extending in the second longitudinal direction, a second lobe extending in the first longitudinal direction, and a third lobe extending in the first lateral direction, and the second lobe structure portion includes a fourth lobe extending in the second longitudinal direction, a fifth lobe extending in the first longitudinal direction, and a sixth lobe extending in the second lateral direction, a first connecting lobe extends in the first longitudinal direction and is connected with the second lobe of the first lobe structure portion and the second lobe of the second lobe structure portion, and a second connecting lobe extends in the second longitudinal direction and is connected with the first lobe of the first lobe structure portion and with the fourth lobe of the second lobe structure portion.

The combustor liner according to any preceding clause, wherein the liner further includes a plurality of reverse dilution openings therethrough, respective ones of the plurality of dilution openings and respective ones of the plurality of reverse dilution openings being circumferentially arranged in an alternating arrangement about the liner, each reverse dilution opening including a main dilution opening portion and a plurality of secondary dilution opening portions extending outward from the main dilution opening portion, the main dilution opening portion comprises a cylindrical main dilution opening defined by an outer wall extending about a centerline axis of the cylindrical main dilution opening through the liner, the cylindrical main dilution opening defining a longitudinal direction extending in an upstream direction and a downstream direction with respect to the centerline axis, a first lateral direction orthogonal to the longitudinal direction, and a second lateral direction orthogonal to the longitudinal direction, and the plurality of secondary dilution opening portions comprises a first slotted secondary dilution opening extending outward from the an upstream side of the cylindrical main dilution opening in the first lateral direction and in the downstream direction, and a second slotted secondary dilution opening extending outward from the upstream side of the cylindrical main dilution opening in the second lateral direction and in the downstream direction.

A combustor liner including at least one dilution opening therethrough, the dilution opening including an inlet portion having an inlet on an inlet side of the liner and extending partially through the liner, and an outlet portion being in flow communication with the inlet portion within the liner, the outlet portion including a plurality of lobe portions extending outward from the inlet portion along a length of the liner from the inlet portion to an outlet side of the liner, the outlet portion defining an exit area greater than an inlet area of the inlet portion, and each of the plurality of lobes being arranged to direct a flow of dilution air in respectively different outward directions from the dilution opening.

Although the foregoing description is directed to some exemplary embodiments of the present disclosure, other variations and modifications will be apparent to those skilled in the art, and may be made without departing from the spirit or the scope of the disclosure. Moreover, features described in connection with one embodiment of the present disclosure may be used in conjunction with other embodiments, even if not explicitly stated above.

We claim:

1. A combustor liner for a gas turbine, the combustor liner comprising:

a liner at least partially defining a combustion chamber, the liner having a cold surface side exposed to a flow passage surrounding the liner and a hot surface side exposed to the combustion chamber, wherein the liner includes a plurality of dilution openings extending therethrough from the cold surface side to the hot surface side, at least one dilution opening of the plurality of dilution openings defined by (a) a main dilution opening portion defining a main dilution opening perimeter about a centerline axis of the main dilution opening portion, the main dilution opening portion extending through the liner from the cold surface side to the hot surface side, and (b) a plurality of secondary dilution opening portions arranged about the main dilution opening perimeter and extending outward from the main dilution opening portion, each of the plurality of secondary dilution opening portions (i) extending through the liner from the cold surface side to the hot surface side and, (ii) in a plan view of the cold surface side of the liner, having a length extending in a first direction, and a constant width along the length in a direction orthogonal to first direction, the length being greater than the width.

2. The combustor liner according to claim 1, wherein the main dilution opening perimeter is defined by an outer wall extending about the centerline axis of the main dilution opening portion through the liner, the main dilution opening portion defining a longitudinal direction extending in an upstream direction and a downstream direction with respect to the centerline axis, a first lateral direction orthogonal to the longitudinal direction, and a second lateral direction orthogonal to the longitudinal direction, the plurality of secondary dilution opening portions comprises a first slotted secondary dilution opening extending outward from a downstream side of the main dilution opening portion and extending in the first lateral direction and in the upstream direction, and a second slotted secondary dilution opening extending outward from the downstream side of the main dilution opening portion in the second lateral direction and in the upstream direction.

3. The combustor liner according to claim 2, wherein an airflow ratio between the main dilution opening portion and the plurality of secondary dilution opening portions is defined by:

$$A(\text{slot})/A(\text{main})=0.4 \text{ to } 2.0,$$

where A(slot) is an airflow area of the plurality of secondary dilution opening portions, and A(main) is an airflow area of the main dilution opening portion.

4. The combustor liner according to claim 1, wherein the plurality of secondary dilution opening portions comprises a plurality of slit openings extending outward from an outer wall defining the main dilution opening perimeter, the first direction being a radial direction extending radially outward from the centerline axis.

5. The combustor liner according to claim 4, wherein an airflow ratio between the main dilution opening portion and the plurality of slit openings has a range defined by:

$$A(\text{slit})/A(\text{main})=0.1 \text{ to } 1.0,$$

where, A(slit) is an airflow area of the plurality of slit openings, and

A(main) is an airflow area of the main dilution opening portion.

6. The combustor liner according to claim 4, wherein the plurality of slit openings are curved slit openings extending from the outer wall.

7. The combustor liner according to claim 4, wherein the at least one dilution opening further includes at least one tertiary dilution portion arranged at an outer end of at least one of the plurality of slit openings.

8. The combustor liner according to claim 7, wherein a width of the tertiary dilution portion is smaller than a width of the main dilution opening portion.

9. The combustor liner according to claim 8, wherein the tertiary dilution portion comprises a cylindrical tertiary dilution opening extending through the liner.

10. The combustor liner according to claim 7, wherein at least one of the plurality of slit openings is a curved slit opening extending from the outer wall, and a width of the tertiary dilution portion is smaller than a width of the main dilution opening.

11. The combustor liner according to claim 10, wherein the tertiary dilution portion comprises a cylindrical tertiary opening extending through the liner.

12. The combustor liner according to claim 1, wherein the main dilution opening perimeter is defined by an outer wall extending about the centerline axis of the main dilution opening portion through the liner, the main dilution opening portion defining a longitudinal direction extending in a first longitudinal direction and a second longitudinal direction opposite the first longitudinal direction with respect to the centerline axis, a first lateral direction orthogonal to the longitudinal direction, and a second lateral direction orthogonal to the longitudinal direction, the at least one of the plurality of secondary dilution opening portions comprises a first slotted secondary dilution opening extending outward from a first side of the main dilution opening portion in the first lateral direction and in the second longitudinal direction, and a second slotted secondary dilution opening extending outward from a second side of the main dilution opening portion in the second lateral direction and in the first longitudinal direction.

13. The combustor liner according to claim 12, wherein the first slotted secondary dilution opening extends at a downstream angle with respect to the first lateral direction and the second longitudinal direction, and the second slotted secondary dilution opening extends at an upstream angle with respect to the second lateral direction and the first longitudinal direction.

14. The combustor liner according to claim 12, wherein a slot width of the first slotted secondary dilution opening is less than a width of the main dilution opening portion, and a slot width of the second slotted secondary dilution opening is less than the width of the main dilution opening portion.

15. The combustor liner according to claim 1, wherein the main dilution opening portion and the at least one of the plurality of secondary dilution opening portions are arranged in series from a first surface side of the liner to a second surface side of the liner, a first end of the main dilution opening portion being arranged at the first surface side of the liner and a second end of the main dilution opening portion being arranged within the liner between the first surface side of the liner and the second surface side of the liner, and a first end of the at least one of the plurality of secondary dilution opening portions being arranged at the second end of the main dilution opening portion and a second end of the at least one of the plurality of secondary dilution opening portions being arranged at the second surface side of the liner.

16. The combustor liner according to claim 15, wherein the at least one of the plurality of secondary dilution opening portions defines a lobe structure having a plurality of lobes at the second surface side of the liner.

17. The combustor liner according to claim 16, wherein the main dilution opening portion is defined by an outer wall extending about a centerline axis of the main dilution opening through the liner, the main dilution opening defining a longitudinal direction extending in a first longitudinal direction and a second longitudinal direction opposite the first longitudinal direction with respect to the centerline axis, and a first lateral direction orthogonal to the longitudinal direction, and a second lateral direction orthogonal to the longitudinal direction, the lobe structure comprises a first lobe structure portion on a first side of the centerline axis, and a second lobe structure portion on a second side of the centerline axis.

18. The combustor liner according to claim 17, wherein the first lobe structure portion includes a first lobe extending in the first longitudinal direction, a second lobe extending in the second longitudinal direction, and a third lobe extending in the first lateral direction, and the second lobe structure portion includes a fourth lobe extending in the first longitudinal direction, a fifth lobe extending in the second longitudinal direction, and a sixth lobe extending in the second lateral direction, a first connecting lobe extends in the first longitudinal direction and is connected with the second lobe of the first lobe structure portion and the fifth lobe of the second lobe structure portion, and a second connecting lobe extends in the second longitudinal direction and is connected with the first lobe of the first lobe structure portion and with the fourth lobe of the second lobe structure portion.

19. The combustor liner according to claim 17, wherein the first lobe structure portion includes a first lobe extending in the first longitudinal direction, a second lobe extending in the second longitudinal direction, and a third lobe extending in the first lateral direction, and the second lobe structure portion includes a fourth lobe extending in the first longitudinal direction, a fifth lobe extending in the second longitudinal direction, and a sixth lobe extending in the second lateral direction, a first connecting lobe extends in the second longitudinal direction and is connected with the second lobe of the first lobe structure portion and the fifth lobe of the second lobe structure portion, and a second connecting lobe extends in the first longitudinal direction and is connected with the first lobe of the first lobe structure portion and with the fourth lobe of the second lobe structure portion.

20. The combustor liner according to claim 17, wherein the first lobe structure portion includes a first lobe extending in the second longitudinal direction, a second lobe extending in the first longitudinal direction, and a third lobe extending in the first lateral direction, and the second lobe structure portion includes a fourth lobe extending in the second longitudinal direction, a fifth lobe extending in the first longitudinal direction, and a sixth lobe extending in the second lateral direction, a first connecting lobe extends in the first longitudinal direction and is connected with the second lobe of the first lobe structure portion and the second lobe of the second lobe structure portion, and a second connecting lobe extends in the second longitudinal direction and is connected with the first lobe of the first lobe structure portion and with the fourth lobe of the second lobe structure portion.

* * * * *